United States Patent [19]

Folkesson et al.

[11] 4,392,368

[45] Jul. 12, 1983

[54] ARRANGEMENT FOR PRESSES

[75] Inventors: Hans Folkesson, Trollhättan; Ulf Überg, Gothenburg, both of Sweden

[73] Assignee: Saab-Scania Aktiebolag, Linkoping, Sweden

[21] Appl. No.: 216,998

[22] PCT Filed: Apr. 17, 1979

[86] PCT No.: PCT/SE79/00093

§ 371 Date: Dec. 17, 1980

§ 102(e) Date: Nov. 24, 1980

[87] PCT Pub. No.: WO80/02239

PCT Pub. Date: Oct. 30, 1980

[51] Int. Cl.[3] ..... B21D 22/12

[52] U.S. Cl. ..... 72/63; 72/7; 364/851

[58] Field of Search ..... 72/453.18, 453.01, 7, 72/21, 63, 54, 57; 364/851, 852, 860

[56] References Cited

U.S. PATENT DOCUMENTS

| | | | |
|---|---|---|---|
| 2,693,780 | 11/1954 | Winter | 72/21 |
| 3,290,919 | 12/1966 | Malinak | 72/63 |
| 3,357,218 | 12/1967 | Mitchell | 72/63 |
| 3,635,061 | 1/1972 | Rydell | 72/63 |
| 3,824,574 | 7/1974 | Ironside | 364/860 |
| 3,962,895 | 6/1976 | Rydell | 72/63 |
| 3,987,283 | 10/1976 | Moeller | 192/127 |

FOREIGN PATENT DOCUMENTS 322193 7/1970 Sweden .

*Primary Examiner*—Gene Crosby

*Attorney, Agent, or Firm*—James E. Nilles; James R. Custin

[57] ABSTRACT

A press operating with hydraulic pressure comprises a pair of relatively movable components (8, 11) which during a pressing operation carry out a relative movement which is sensed. By use of the sensed relative movement a control signal is generated which is used for regulating the hydraulic pressure so that this is caused to vary with the relative movement according to a certain functional relationship. For generating the control signal a manually programmable electrical function generator (23) is provided, preferably a panel (29) comprising plug contacts (34), on which a plurality of pairwise associated pressure and movement values, constituting electrically and visually readable points in the desired functional relationship, can be set up. To the input (28) of the function generator a measurement signal is fed which is a measure of the relative movement covered by the two components and which makes the function generator read off and issue at its output (41–43) the pressure values as the set movement values corresponding thereto are reached.

5 Claims, 3 Drawing Figures

ARRANGEMENT FOR PRESSES

TECHNICAL FIELD

The present invention relates to an arrangement for presses particularly those intended for forming sheet metal blanks and wherein forming is effected by hydraulic pressure which varies during a pressing operation. Presses of the type here under consideration comprise a pair of relatively movable components which are made to carry out a relative movement during the pressing operation, means for sensing the said movement and generating a control signal which, according to a functional relationship relevant to the pressing operation, depends on the second movement, and a hydraulic system for regulating the hydraulic pressure by means of the central signal so that during the pressing operation hydraulic varies according to the functional relationship. More specifically, the invention relates to an improved arrangement for controlling the hydraulic working pressure which acts in such a press during a pressing operation and which thereby controls, either directly or indirectly, the course of the operation.

THE PRIOR ART

Pressure control of this kind in a press is necessary so that satisfactory working results may be obtained when carrying out deep drawing and similar pressing operations when sheet metal blanks are to be given a complicated form. For this purpose, various solutions may be found on the market, based on drawing a curve which represents on a specific scale the relationship between the hydraulic pressure and the movements carried out, which relationship has been found to be suitable for a pressing operation. A templet is then produced from plate or other rigid material to have a contour that corresponds accurately with the curve, and this templet is fixed to a movable means appertaining to the press which mechanically detects the movements involved. A templet sensor, the sensing part of which follows the contour of the templet and is movable in the lateral direction relative to the displacement direction of the templet, during the pressing operation transmits its lateral movements, obtained from the displacements of the templet to a signal generator in the form of a pressure control valve or a potentiometer which controls an electro-hydraulic valve via an amplifier. The latter arrangement is described in more detail in U.S. Pat. No. 3,962,895.

To establish the relationship between the relative movement and the working pressure which the contour of the templet represents generally calls for a very comprehensive sampling process, particularly for parts with high drawing depth ratio, and it is not unusual before starting series-production for 20 samples to have to be made, with adjustments in between at different points over the contour of the templet before a satisfactory work-piece is obtained. Obviously, a templet cut out of plate is less suitable, but even if a cam plate is used, the contour of which is formed by a steel strip which is adjustable by means of a number of positioning screws connected to the steel strip, such adjustment work is still time-consuming and troublesome and cannot be carried out without tools.

Furthermore, it is difficult to carry out a purely mechanical templet-sensing which is very accurate without the transmitted movement varying from one run to the next due to mechanical imperfections in the signal generating control valve.

A templet-sensing arrangement for hydraulic presses which works with photocells is known from Swedish Pat. No. 322 193. The templet which, as in the above-described arrangement, is displaced by one of the moving components of the press, can be made in this instance from a piece of paper which is cut so that it gives the desired pressure curve and which is then inserted in a holder so that depending on its movement, light from a light source located on one side of the templet is screened from or reaches a row of photocells arranged on the other side. The arrangement requires that every time a new part is to be produced a templet must be made, or the pressure curve adjusted on an existing one if it is not desired to file all the prepared templets for future use, and the procedure for trimming a pressure curve into shape is basically just as labour and time-consuming as with a conventional templet made of plate, for in this case too the templet must be removed from the machine for each modification of the pressure values, and after adjustment, which can be effected by cutting away or sticking on a piece of paper along the contour of the pattern, it must be inserted again in its place in the holder.

With the known pressure regulating arrangements there is also no flexibility during series-production, as might be described for accommodating the variations which may arise concerning the hardness of the basic material or other characteristics which are significant for the choice of working pressure. Neither does any one of the prior arrangements allow a simple and quick adjustment of the pressure curve in order to compensate for temperature differences in the pressure medium while pressing is going on, or for the rises or reductions in pressure occasioned thereby, which in certain circumstances can result in an interruption of work several times a day.

THE OBJECT OF THE INVENTION

It is therefore the object of the present invention to provide a pressure-regulating arrangement for use in presses which operate with hydraulic pressure that is to be varied during a pressing operation, which arrangement is not encumbered with the disadvantages that the known arrangements display, as mentioned above, but enables the functional relationship which should exist during a pressing operation between the hydraulic pressure and the forming movement to be programmed into the press quickly and with few manipulations, and has such flexibility that a relationship inserted the press will be simple to alter and adjust subsequently without any appreciable interruption in a continuous production process.

Another aim which the invention seeks to achieve is to generate the control signal which represents the working pressure in a way that is not subject to errors due to inaccurate movement sensing, mechanical wear, etc., and whereby the course of a pressing operation can be followed visually, so that the movement and pressure values prevailing at any given moment according to the relevant relationship can be observed, and the latter can be reproduced for filing, when applied, without preventing the same relationship being used in the production process.

THE SOLUTION

This is accomplished according to the primary characteristic of the invention in that the said means comprise a manually programmable electric function generator which has a large number of contact points arranged in rows and columns for reproducing in electrically readable form pairwise associated pressure and movement values constituting points in the relevant functional relationship and which at its output is connected to the hydraulic system, while its input side is operatively connected via an electrical measurement transducer to either of the said relatively movable components of the press so that the function generator receives a measurement signal which is a measure of the movement covered and which makes it in turn and in sequence read off and produce at its output the said pressure values as the movement values are reached.

The function generator consists preferably of a programming panel, the electrical parts of which comprise in a known way two crossing systems of parallel conductors situated in different planes, which are separately assigned to the pressure or movement values respectively and which increase stepwise and gradually within each system, from a common starting point. The panel also has in a known way a perforated board covering the conductor systems, the holes in which are located right at the intersection points of the system, and suitable plug contacts for fitting in the holes.

For programming the pressure and movement relationship, the procedure is to insert, for each of the movement values, a plug contact in the hole which corresponds with a selected demand pressure value so that the plug contact positions on the panel depict as a whole the pressure curve believed to be suitable for a certain pressing operation. If the working results are not satisfactory it is possible with a few manipulations to adjust the curve rapidly, by moving one or more of the plugs so that the demand value of the hydraulic pressure for a specific relative position of the movable components of the press, or during a certain part of the total forming movement, is raised or lowered compared with the former value.

Each functional relationship programmed in this way can be recorded easily and rapidly for filing by providing the programming panel with a diagram sheet which is pierced by the plug contacts as they are inserted into the holes in the panel.

It is also of great practical importance that, according to a further characteristic of the invention, the function generator has a row of lamps or the like which are lit in turn, in time with the sensed movement values. In this way, the operator can easily check the progress of a pressing operation.

DESCRIPTION OF A PREFERRED EMBODIMENT

Figure 1:
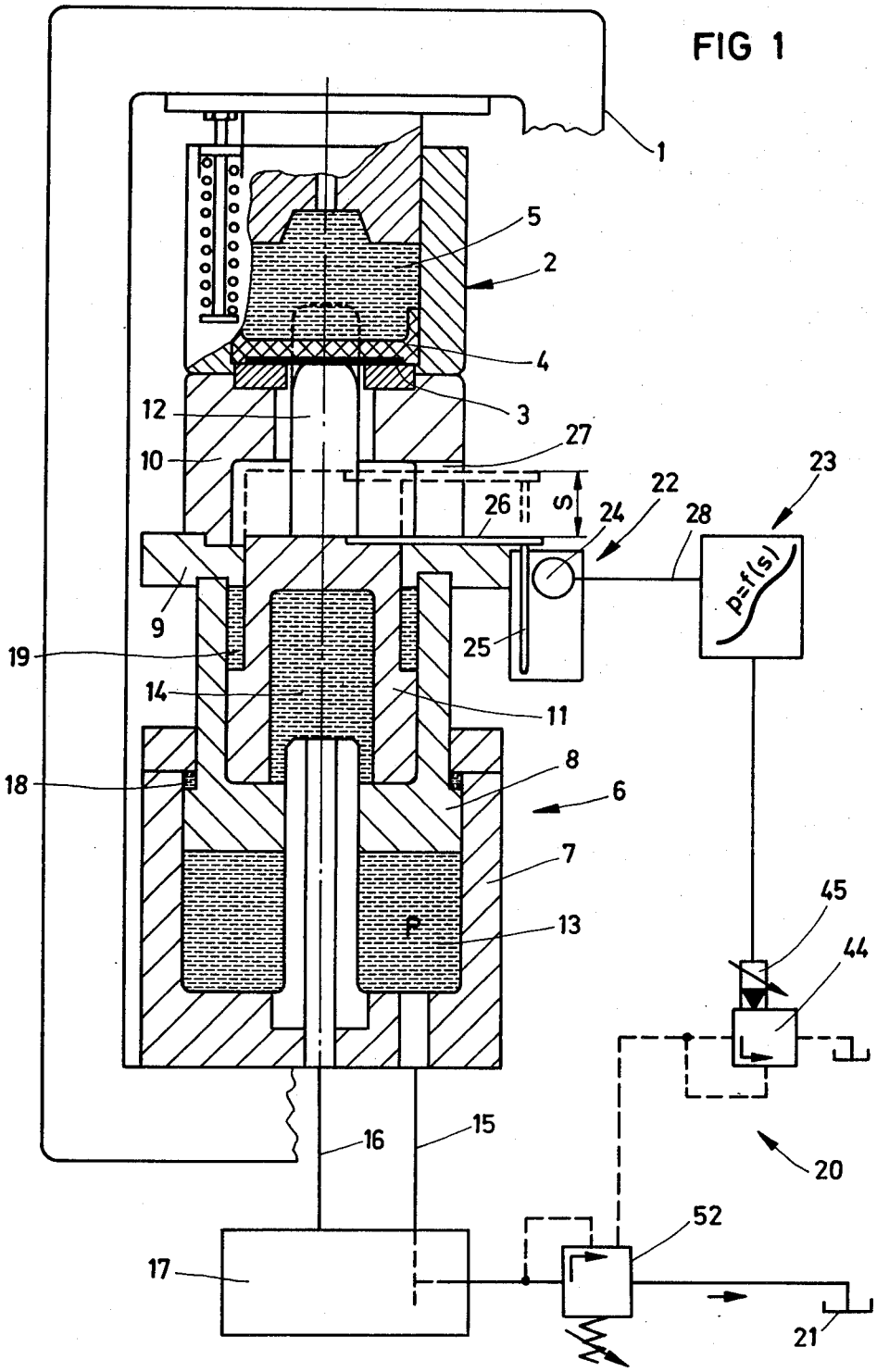
Figures 2, 3:
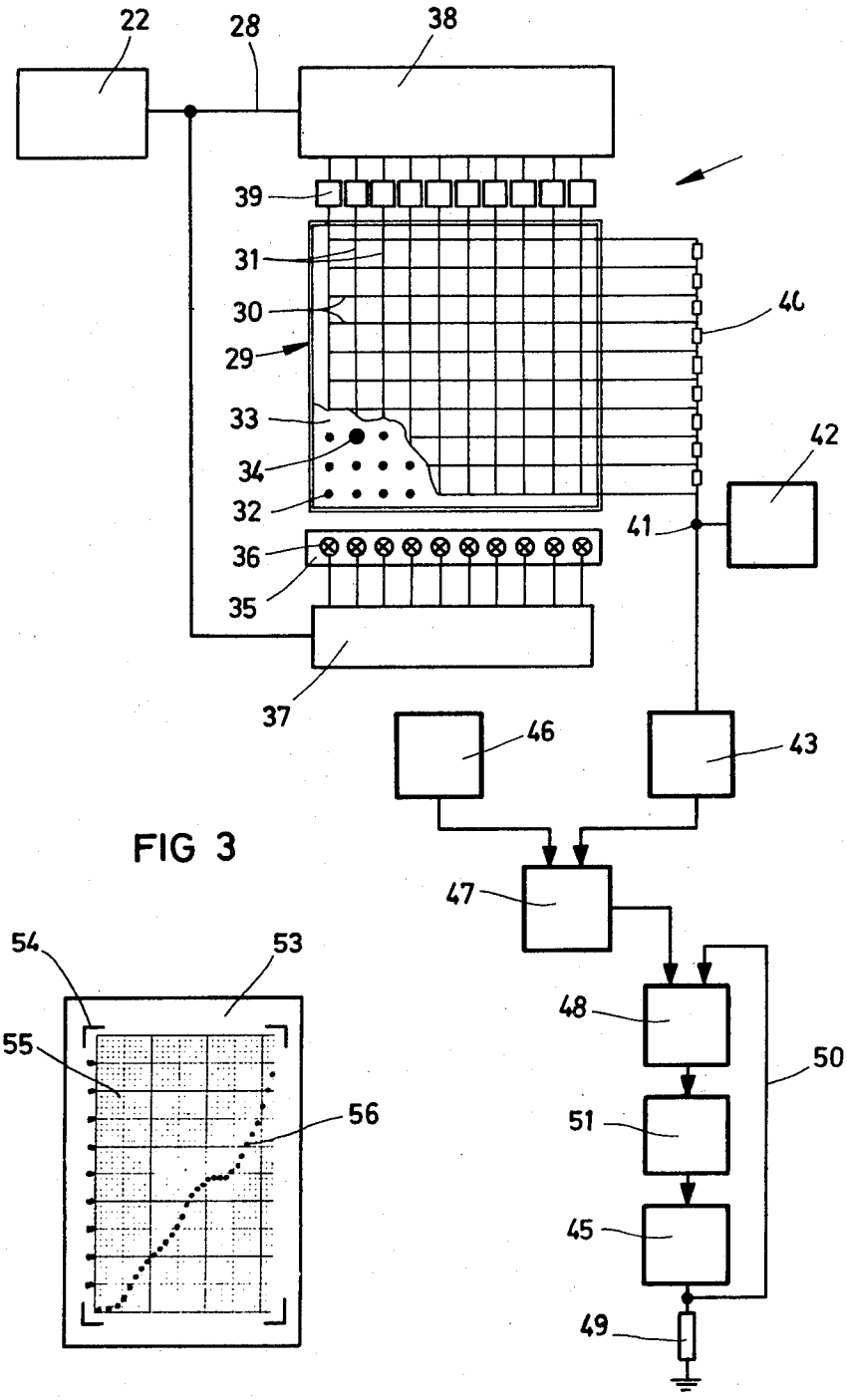

The invention will be explained in more detail in the following with reference to the attached drawing, in which FIG. 1 is an axial section through a hydraulic press with the arrangement according to the invention, FIG. 2 is an electrical circuit diagram of the arrangement, and FIG. 3 illustrates a programmed relationship between the forming movements and the pressure.

The invention can be used on any type of press in which forming depends on hydraulic pressure that is controlled during the forming process and, and thus also on a hydraulically driven press wherein the forming part works mechanically, and likewise in a press which is driven purely mechanically and has a hydraulic forming chamber in which the hydraulic pressure which is effective during the forming process is controlled by altering the volume of the chamber. However, for the sake of simplicity the invention is here described only in its application to a hydraulic press constructed according to FIG. 1 in 1 in Swedish Pat. No. 7316381-8 (Publication No. 395.391) corresponding to U.S. Pat. No. 3,962,895 and reference should be made thereto concerning any details which are not described below.

In FIG. 1, 1 designates a stand which bears at its top a unit 2 which is specially designed for forming sheet metal blanks 3 and comprises a membrane 4 which defines the bottom of a closed chamber 5 containing a constant volume of fluid.

On its lower section the stand 1 bears a hydraulic assembly 6 comprising a cylinder 7 in which an outer pressing piston 8 is inserted, which extends at its top, via an intermediate base 9, into a draw ring 10 on which the sheet metal blank 3 is placed when the press is in the open position. Running in the outer piston 8, the hydraulic assembly also has an inner piston 11 which bears a central tool component, in this instance constructed as a die 12. The chambers 13 and 14 underneath the outer and inner pistons, respectively, are filled with hydraulic fluid and are connected via pressure lines 15 and 16 to a hydraulic system comprising a pump assembly 17. The hydraulic system is designed to effect all the fluid transportation required for closing the press as the chamber 13 is contracting, whereby during the expansion of the fluid chamber 13 the outer piston 8 moves upwards into the position shown in the Figure, bringing the inner piston 11 with it; similarly, for opening the press, pressure medium is introduced into the two annular chambers 18 and 19 which are respectively located between the cylinder 7 and the outer piston, and between the outer piston and the inner piston.

The forming operation itself is effected, as is known in this kind of press, in that the inner piston 11 together with the die 12 is made to move upwards by the supply of pressure fluid from the pumping assembly 17 via the line 16 into the chamber 14, so that the sheet metal blank 3 is drawn over the die and deformed. During this process a high fluid pressure arises in the forming chamber 5, which leads to the result that under the influence of the membrane 4 the sheet metal blank is pressed against all sides of the die and assumes the shape thereof, and in addition the casing of the unit 2, the draw ring 10 which rests thereon and the outer piston 8 move downwards while fluid is controlled by drained from the chamber 13 via the line 15 to the hydraulic system. As explained in Swedish Pat. No. 7316381-8 (Publication No. 395.391 corresponding to U.S. Pat. No. 3,962,895), with so-called matrix-forming, these relative movements of the two tool components are the reverse of what is described here.

With this type of pressing operation the specific pressure in the forming chamber 5 is of great importance for the working results and it has been found that this pressure should be controlled so that it varies in a specific way with the mutual movement of the tool components, that is, as a function of the relative movements between the outer piston 8 and the inner piston 11, which parts are hereinafter called the two moveable components of the press. One way proposed to accomplish this pressure control is to allow the fluid which is drained from the hydraulic assembly 6 during forming to pass through a valve arrangement 20 which ensures that the pressure upstream from the valve arrangement and with it the pressure in the fluid chamber which contracts during forming (i.e. the chamber 13 in the example of die-forming) corresponds to a demand value which varies in dependence upon the mutual displacement of the two movable components of the press. Accordingly, the valve arrangement 20 indirectly controls the fluid pressure which is effective in the forming chamber 5. The fluid drained off in this way can either go to a tank 21 or, as described in U.S. Pat. No. 3,962,895, it can be returned to the fluid chamber which is expanding (in the example this is chamber 14) so as to cooperate in this way in the work which the upwards-moving tool component is carrying out, thereby reducing the consumption of energy.

Thus, the hydraulic pressure which controls the forming is either the pressure which acts directly on the blank during the forming process or the indirectly acting pressure p which, in a press of the kind described above, prevails in a fluid chamber appertaining to a hydraulic assembly and compressed during the forming process. According to the present invention, that hydraulic pressure is regulated with the aid of an arrangement which consists basically of a measurement transducer 22 for sensing the mutual displacement s of the two movable components 8 and 11 of the press, and an electrical function generator 23 for manual programming of the functional relationship $p=f(s)$ between the said pressure p and the displacement s that is to apply during a forming operation and whereby, according to the development of the sensed displacement movement, a control signal 15 is produced which varies according to the programmed relationship and is supplied to the valve arrangement 20.

The measurement transducer 22, is assumed to be the type of optical absolute position transducer which produces a digitally coded measurement signal. It comprises a grid disc 24 which is attached rotatably but not displaceably to the intermediate base 9, and a rod 25 which rotates the grid disc and which is attached to the inner piston 11 by means of a bracket 26. The bracket 26 projects out laterally through a slit 27 in the draw ring 10 that has a vertical extent such that the bracket can move freely relative to the draw ring during the upwards displacement of the inner piston. The grid disc 24 thereby rotates through an angle which exactly corresponds to the mutual displacement between the two moving components 8 and 11 and which is unambignously represented by the digital measurement signal of the transducer 22 which is supplied to the input 28 of the function generator. There is nothing to prevent an analogue position transducer, such as, a contact-free potentiometer, from being used instead, in which case another adaptation may be effected between the position transducer 22 and the function generator.

The function generator, the electrical structure of which is shown in FIG. 2, comprises advantageously a conventional programming panel 29 with two conducting systems which cross each other and which are located in separate planes so that the conductors themselves do not provide any link between the systems. Each system comprises a large number of equidistantly located conductors (of which only a small number are shown in the drawing and the two systems), together form a regular checked pattern, the rows 30 and columns 31 of which represent pressure and movement values respectively, all gradually increasing in small steps from the lower left-hand corner 32 of the panel.

As shown here, the conductors systems are covered by a perforated sheet 33 which is made of insulating material and in which there are holes located right at the intersection points. By fitting a plug contact 34 in a hole, the two row and column conductors which pass nearest it are connected to each other, thus allowing a point in a desired function relationship to be programmed in thefunction generator. On the board, the function values corresponding to the positions of the holes should be given, the pressure values expediently in percent of the maximum operating pressure of the press, and displacement values in appropriate units of length. The programming panel is also provided with an illuminated array 35, the lamps 36 of which are associated one by one with the columns 31 of the panel and are connected to a decoder 37 which receives measurement signals from the position transducer 22 and which is designed to light the lamps 36 in turn and in sequence as the movement values corresponding to the columns 31 are attained.

At the input 28 the function generator has a second decoder 38 which is connected to each of the column conductors 31 via a gate 39, and which is designed so that, during a forming operation, it activates one of the column conductors 31 with the aid of the measurement signal received, which will occur in the same sequence and at the same moment that the corresponding lamp 36 is lit. This activation can be effected so that the conductor in question is connected to electrical earth by means of its gate while all the remaining column conductors remain inactive due to the fact that their gates have a high impedance to earth.

The output side of the function generator comprises a resistance chain 40 in which each separate resistance is connected between a pair of adjacent conductors in the rows 30, and has a resistance value such that the series resistance for the chain increases, preferably by the same amount at each step and calculated from the terminal point 41 according to the pressure values appertaining to the rows. A current generator 42 connected to the terminal point provides a current of constant value and while forming is going on, this current can be conducted to earth only via the column conductor 31 which is activated at that moment. Assuming that this is the conductor 31 which is connected to the plug contact 34, the current will accordingly pass through the two lower resistances in the chain 40, then via the horizontal conductor 30 that is engaged by the contact plug, and then via said conductor 31 and its gate to earth, while at the same time all the other paths through the function generator are interrupted. The potential at the point 41 is gradually changed accordingly, in time with the forming movement and by the amount which obviously depends on the row in which the plug contact is inserted.

A voltage with such a characteristic is not, however, used directly for controlling the pressure, but is first modified, according to a characteristic feature of the invention, into a continuously varying signal, this being effected in a filter 43. This can consist of a RC circuit with a variable condenser, and by using this to adjust the filter time-constant in relation to the prevailing relative speed of the moving components in the press, it is possible to smooth, at least to a large extent, the stepwise variation in the direct current produced in the function generator at the transition from one column 31 to another.

If, as in the example shown, the valve arrangement 20 comprises a pressure regulating valve 44 the characteristic of which is such that the pressure is proportional to the current in a spool 45 in the valve, it can be expedient to process the filtered direct current signal in the following way. In an oscillator 46, an alternating current is produced which has a small amplitude compared with the direct current and which is superimposed on the latter in an operational amplifier 47 so that, in a known way, the mechanical hysteresis of the pressure control valve, or its tendency to stick, is eliminated. The summing signal, the mean current value of which corresponds to the current at the point 41, is applied to another operational amplifier 48 where it is compared with the voltage across a low resistance resistor 49 that is, series-connected to the valve spool 45, this voltage, which is therefore a measure of the valve current, being fed back by means of the conductor 50. The resulting control current is supplied finally to an amplifier 51 which forms the drive for the valve spool. The current to this will therefore be proportional to the current at the input of the amplifier and therefore to the potential at the point 41.

In applications where the pressure control calls for large amounts of through-flow, which is the case with presses working in the same way as or in a similar way to the example in FIG. 1, the pressure control valve is operated as a pilot valve controlling a main valve 52. This is dimensioned in such a way that it is capable of taking over all or most of the stream of fluid which is to be drained from the press into the tank 21 or is to circulate from one fluid chamber 13 in the press, through the valve to the other fluid chamber 14.

It will be seen that with the described arrangement an effective and expedient pressure control is obtained, which follows accurately a given relationship $p=f(s)$ which, by means of the arrangement, can be varied within wide limits according to the type of pressing work, and can be modified or adjusted easily and quickly during continuous production. A further advantage which characterises the arrangement according to the invention is that such a relationship can be reproduced with simple means in its form as inserted in the function generator. For this purpose, the programming panel is provided with a sheet of diagram paper 53 (see FIG. 3) which can be provided with printed fitting marks 54 matching the corners of the panel and/or with a checked pattern 55 corresponding to the pattern of holes in the board 33. By means of holders which are not shown, the diagram paper is attached in the correct position on the board after which the actual pressure curve is transferred to the paper pressing by the plug contacts 34 through the paper so that they make a series of holes 56 corresponding with the programmed points. In comparison with the filing of templets which are sensed mechanically or optically, the method affords the advantage that the pressure curve of a certain workpiece can be filed in easily handled form, or can be used for preparing a subsequent operation while the workpiece involved is in production.

We claim:

1. Apparatus for a sheet metal forming press wherein there is at least one component which moves in relation to another part of the press during a forming operation and is controlled in its movements by hydraulic fluid under pressure, said apparatus providing for control of the pressure of said hydraulic fluid in accordance with a predetermined but readily alterable program of relationships between position of said component and magnitude of said pressure, and said apparatus comprising a position transducer that produces a position output which varies in dependence upon the position of said component and pressure regulating means for changing the magnitude of said pressure in correspondence with changes in value of a characteristic of an electrical control current fed to said pressure regulating means, said apparatus being characterized by:

(A) a plurality of elongated, laterally spaced apart position conductors, one for each of a plurality of positions of said component, all extending substantially in one direction;

(B) a plurality of elongated, laterally spaced apart pressure value conductors, one for each of a plurality of magnitudes of said pressure and each extending transversely to all of said position conductors but out of contact with them to be electrically connectable to any selected one of said position conductors by means of a readily disconnectable connector;

(C) input current means normally connected with all of said pressure value conductors for feeding an input current to all of them that has a magnitude for each of them which is different from that of the input current fed to the others and which, for each, corresponds to a unique magnitude of said pressure;

(D) circuit control means comprising:

(1) a decoder connected with said position transducer to receive said position output therefrom, and (2) means under the control of said decoder for establishing each of said position conductors selectably and alternatively in a state of connection with said pressure regulating means or in a state of disconnection therefrom and whereby the position conductor for the existing position of said component is established in one of said states and all of the others are maintained in the other of said states; and (E) electrical circuit means for so connecting all of said pressure value conductors with said pressure regulating means as to feed to the latter a control current having a value that substantially corresponds to the magnitude of the input current fed to a pressure value conductor connected with the position conductor that is in its said one state.

2. The apparatus of claim 1 wherein said input current means comprises a plurality of resistors, one for each pressure value conductor, each connected between its pressure value conductor and an adjacent one, said resistors being connected in series with one another and a source of current so that said magnitude of the input current differs stepwise from one to another of the pressure value conductors.

3. The apparatus of claim 1, further characterized by:

(F) a plurality of signaling devices, one for each of said position conductors; and (G) means for energizing each signaling device, to cause it to issue a perceptible signal, whenever its position conductor is in its said one state.

4. The apparatus of claim 1 wherein all of said position conductors are contained substantially in one plane and extend substantially parallel to one another and wherein all of said pressure value conductors extend substantially transversely to said position conductors and are substantially contained in another plane that is spaced from and substantially parallel to said one plane, further characterized by:

(F) a panel substantially contained in a third plane that is spaced from and substantially parallel to the first two mentioned planes and which has holes for removably receiving a conducting plug that comprises said connector, said holes being so arranged as to enable any selected position conductor to be connected with any selected pressure value conductor by means of said plug.

5. The apparatus of claim 1 wherein said electrical circuit means comprises a capacitance whereby said value of the control current is caused to change gradually but in substantial conformity to stepwise changes in said magnitude of the input current fed to pressure value connectors connected to position conductors that are successively converted to said one state.

* * * * *